United States Patent [19]

Debs

[11] 4,386,644

[45] Jun. 7, 1983

[54] VERTICAL BLIND TILT CONTROL

[75] Inventor: Victor Debs, Staten Island, N.Y.

[73] Assignee: Levolor Lorentzen, Inc., Lyndhurst, N.J.

[21] Appl. No.: 254,655

[22] Filed: Apr. 16, 1981

[51] Int. Cl.[3] ..... E06B 9/26

[52] U.S. Cl. ..... 160/174; 160/176 R

[58] Field of Search ..... 160/166–178

[56] References Cited

U.S. PATENT DOCUMENTS

| | | | |
|---|---|---|---|
| 2,599,884 | 6/1952 | Bennett | 160/176 |
| 2,809,531 | 10/1957 | Moyer | 160/177 |
| 3,425,479 | 2/1969 | Lorentzen et al. | 160/176 R |
| 3,878,877 | 4/1975 | Bruneau | 160/168 |
| 3,918,513 | 11/1975 | Englund et al. | 160/176 R |
| 4,122,884 | 10/1978 | Salzmann | 160/176 R |
| 4,214,622 | 7/1980 | Debs | 160/176 R |
| 4,262,728 | 4/1981 | Debs | 160/168 R |

*Primary Examiner*—Peter M. Caun

[57] ABSTRACT

A vertical blind having a blind head with a tilt rod, a cap mounted to one end of the head and including a bushing, a sleeve connected to the tilt rod and rotatably supported in the bushing, and a worm gear located within the cap and connected to the sleeve, and a worm on a shaft accessible from outside the cap and operatively connected to the worm gear for rotating the same by means of a wand. Alternatively, a sprocket wheel is located within the cap and connected to the sleeve, and a bead chain accessible from the outside passes over the sprocket wheel for rotating the same.

1 Claim, 9 Drawing Figures

VERTICAL BLIND TILT CONTROL

BACKGROUND OF THE INVENTION

The present invention relates to a vertical blind, and more specifically to an end cap for a vertical blind head and a mechanism for rotating the tilt rod of a vertical blind.

Vertical blinds are known in which the tilt rod is rotated by a wand or a crank, or by a pulley or sprocket wheel and a bead chain. Either type of vertical blind tilt rod control requires a different attachment to one end of the vertical blind head and of the tilt rod.

It is an object of the present invention to provide an end cap at one end of a vertical blind head which fits onto an existing vertical blind head and makes it possible to control the tilt rod either by a wand or by a sprocket wheel and bead chain.

DETAILED DESCRIPTION OF A PREFERRED EMBODIMENT

The invention is illustrated by way of example in the accompanying drawings, in which.

Figure 2:
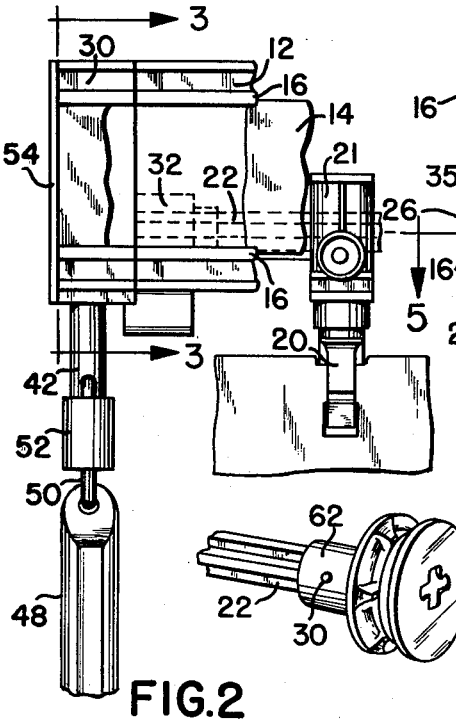
FIG. 2 shows the portion encircled in FIG. 1 on an enlarged scale, with a wand tilter.
Figure 3:
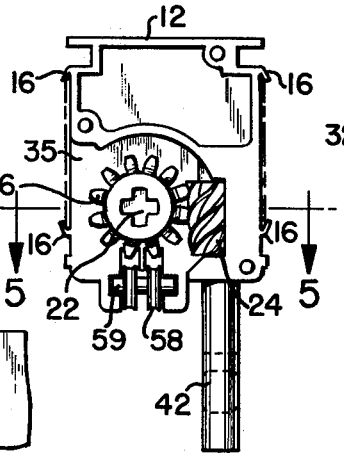
FIG. 3 is an end view of the vertical blind head end cap or bracket, as seen in the direction of the arrows 3—3 in FIG. 2.
Figure 9:
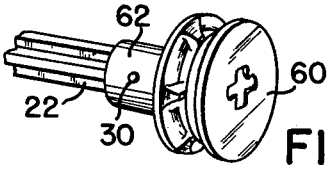
Figure 6:
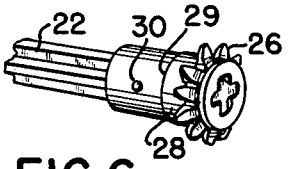
Figure 5:
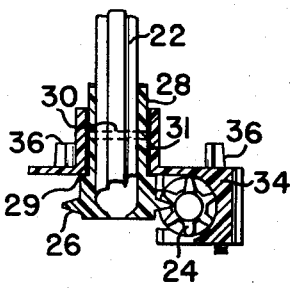
FIG. 5 is a section taken along the line 5—5 of FIG. 3.
Figure 8:
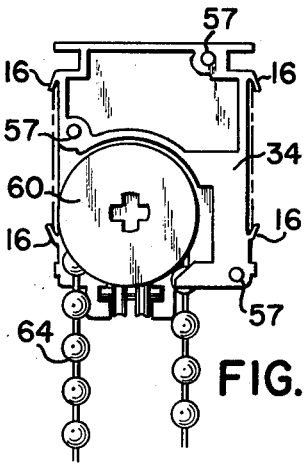
Figure 7:
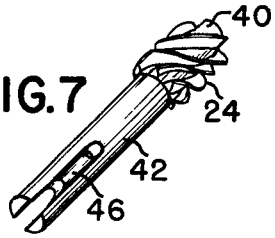

FIGS. 6 and 7 respectively show the worm gear and worm wheel of the wand tilter of FIGS. 2, 3, and 5 in perspective;

FIG. 8 is an end view similar to that of FIG. 3, but showing the tilt rod as being rotated by a sprocket wheel and bead chain; and FIG. 9 is a perspective view of the sprocket wheel and sleeve of the wand tilter according to FIG. 8.

DETAILED DESCRIPTION OF THE DRAWINGS

Figure 1:
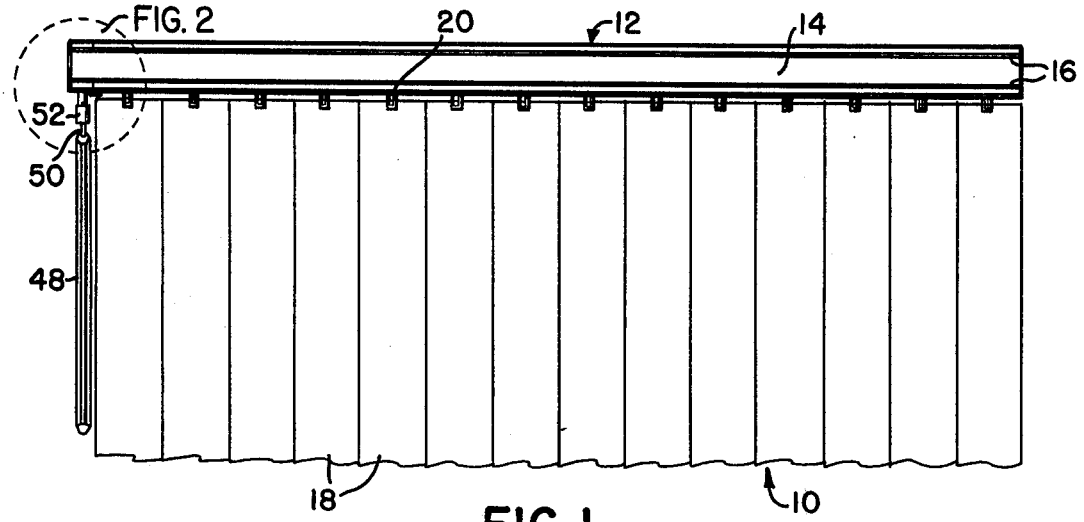
FIG. 1 is an elevational view of a vertical blind.

Referring now to the drawings in detail, FIG. 1 shows a vertical blind, generally designated with the reference numeral 10. The vertical blind comprises a head 12 to be suspended from a support, such as a ceiling. One side or both sides of the head 12 may be provided with a decorative valance 14 which is held in grooves 16.

The vertical blind further comprises a plurality of vanes or slats 18 which are respectively suspended from holders 20 which in turn are supported in carriers 21 (FIG. 2) movable within the blind head 12 in longitudinal direction thereof.

The vertical blind 10 also comprises a tilt rod 22 (shown in FIG. 2) for tilting the vanes or slats 18 about their substantially vertical axes from open to closed position and vice-versa, through an infinite number of intermediate positions, and also means for traversing the vanes 18 to the right or to the left from one end of the blind head to the other and vice-versa, through intermediate positions.

All items described so far are well-known in the art of vertical blinds, and are for instance described in U.S. Pat. No. 4,214,622, issued July 29, 1980, and U.S. patent application Ser. No. 2,457, filed Jan. 10, 1979. They are not described in greater detail here.

Rotation of the tilt rod 22 and thereby pivoting of the vanes or slats 18 is accomplished by either a wand through the intervention of a worm wheel and worm gear (FIGS. 2,3 and 5 to 7), or through a wheel and bead chain combination (FIGS. 8 and 9).

Figure 4:
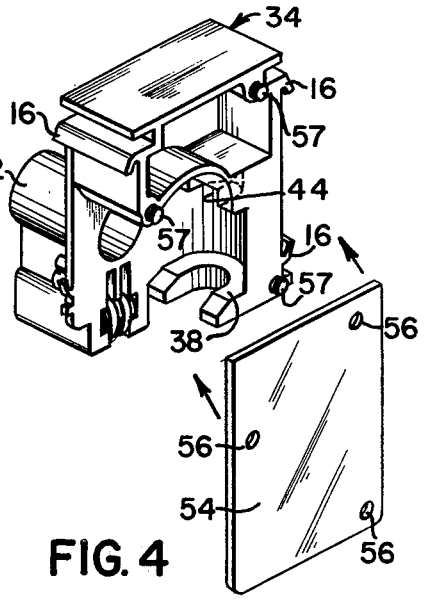
FIG. 4 is a perspective view of the end bracket and its covering plate.

More specifically, with reference to FIGS. 2 and 3, and 5 to 7, the tilt rod 22 is rotated by means of a worm 24 and worm gear 26. The worm gear 26 has integrally connected thereto a sleeve 28 which is positively connected to the tilt rod 22 by a splint 30. The end of the tilt rod 22 with sleeve 28 is rotatably supported in a bushing 32 in an end cap 34, shown in greater detail in FIG. 4. End cap 34 is oriented with respect to head 12 by means of four studs 36, only two of which are shown in FIG. 5. Worm 24 is supported for rotation on a bearing surface 38 in end cap 34, while a portion 40 of the worm shaft 42 is guided in a slot 44 in cap 34. Worm shaft 42 is provided with a transverse slot 46 for connecting a wand 48 thereto by means of a hook-like element 50 and a sleeve 52. This arrangement is known from U.S. Pat. No. 3,425,479 issued Feb. 4, 1969.

The end cap 34 is closed by a plate 54 which has three bores 56 by means of which the plate 54 can be pressed over resilient studs 57 onto cap 34 to thereby hold the plate to the cap by snap-on action.

The end cap is also provided with rollers 58 on a shaft 59 over which a traverse cord (not shown) passes into the vertical blind head 12 for traversing the vanes 18.

The structure of end cap 34 is such that it permits easy installation of the tilt rod control mechanism. It is merely necessary to fasten the sleeve 28 with its gear 26 on tilt rod 22, by boring a hole 31 through the sleeve and through the tilt rod 22 on a suitable jig and to pass the splint or pin 30 through both. Thereafter, the worm 26 is introduced, from the left side in FIG. 4, into cap 34 so that it rests in position on support 38 and passes into groove 44 with end portion 40. Then the opposite end of the tilt rod 22 is passed through bushing 32 and from there through the blind head 12 and carriers 21 until sleeve 28 with its edge 29 comes to rest against wall 35 of cap 34 while the teeth of gear 26 engage worm 24. Both gear 26 and worm 24 thus hold themselves in place without any additional means, except for a snap ring (not shown) at the opposite end of tilt rod 22, which snap ring engages the end of the head 12. The plate 54 is then snapped in place.

The same bracket 34 can also be used if it is desired to have the tilt rod controlled by a sprocket wheel and bead chain instead of by the worm and worm gear.

More specifically, as shown in FIGS. 8 and 9, it is merely necessary to install a sprocket 60 with a sleeve 62 and fasten it on tilt rod 22. A bead chain 64 passes over grooves in sprocket 60 and thereby permits rotation of the tilt rod 22 by pulling at the bead chain 64 in one direction or the other.

It will be evident from the above, that with the end cap of the present invention attached to a vertical blind head it is possible to control the tilt rod of the vertical blind either by a worm, worm gear and wand, or by a sprocket wheel and bead chain or the like, without requiring any basic changes at the head per se. This simplifies inventory and would even make it possible to switch upon installation, if desired.

The end cap, gear and worm are preferably made from a synthetic material, such as Nylon or Delrin, or from a suitable metal.

I claim:

1. An end cap for connection to one end of a head of a vertical blind and for receiving therein tilt rod operating means selectively formed by (a) a sprocket wheel having a sleeve and to be rotated by a bead chain, and (b) the combination of a gear having a sleeve, and a worm arranged on a worm shaft and meshing with said gear; said cap comprising: a housing having a wall, a bushing connected to said wall for receiving therein part of a tilt rod in spaced relationship thereto and for selectively rotatably supporting one of said sleeves when connected to said tilt rod, said housing being open opposite said wall and adapted to receive in said housing said sprocket wheel and worm gear respectively, said housing also having a passage for receiving therein said worm shaft below said worm, and a supporting surface extending substantially horizontally and semi-annularly around said passage for supporting thereon said worm, whereby said worm shaft and worm can be introduced from one side into said passage and said worm supported on said surface.

* * * * *